United States Patent [19]

Jarman et al.

[11] 4,315,424

[45] Feb. 16, 1982

[54] VEHICLE BODY CLAMP

[76] Inventors: Davis R. Jarman, 612 Ward Dr.; Virgil H. Hinson, 206 Fairway Oak, both of Brunswick, Ga. 31520

[21] Appl. No.: 114,103

[22] Filed: Jan. 16, 1980

[51] Int. Cl.[3] ..... B21J 13/02

[52] U.S. Cl. ..... 72/479; 24/248 R; 24/263 B; 72/457; 72/705

[58] Field of Search ..... 254/18, 24; 72/705, 72/457, 479; 294/116; 24/248 E, 248 R, 251, 263 R, 263 SW, 263 B, 263 SB; 269/229, 234, 239, 237

[56] References Cited

U.S. PATENT DOCUMENTS

| | | | |
|---|---|---|---|
| 222,112 | 11/1879 | Wilson | 254/18 |
| 579,022 | 3/1897 | Snediker | 269/239 X |
| 1,322,920 | 11/1919 | Malbon | 294/116 |
| 1,538,406 | 5/1925 | McCarty et al. | 294/116 |
| 2,817,492 | 12/1957 | Case | 294/116 X |
| 2,990,961 | 7/1961 | Schneider | 24/251 X |
| 3,896,526 | 7/1975 | Joiner | 24/251 X |
| 3,941,363 | 3/1976 | Ogg | 269/237 X |
| 3,986,746 | 10/1976 | Chartier | 294/116 |

FOREIGN PATENT DOCUMENTS

| | | | |
|---|---|---|---|
| 2535482 | 2/1976 | Fed. Rep. of Germany | 254/18 |

*Primary Examiner*—Robert C. Watson
*Attorney, Agent, or Firm*—Harvey B. Jacobson

[57] ABSTRACT

An elongated base if provided including a pair of opposite side opposing fulcrum surfaces disposed in a plane extending therebetween transversely of the base. A pair of elongated longitudinal side-by-side levers are disposed between the fulcrum surfaces and include opposite end portions projecting from opposite sides of the aforementioned plane. A first pair of end portions define opposing jaw faces for clamping an auto body portion therebetween and anchor structure is carried by the base for applying a pulling force thereon in a direction opposite to the direction in which the first end portions project. The elongated levers, when retracted in said opposite direction relative to the base, are longitudinally slidable relative to each other when the second pair of end portions are spaced apart and structure is provided for interlocking the levers against longitudinal displacement relative to each other when the second pair of end portions are forced together by engagement of the fulcrum surfaces on the remote sides of the levers as the result of the levers being displaced relative to the base in a direction to advance the first pair of end portions of the levers. The remote surfaces of the levers are slightly divergent toward the second end portions thereof and displacement of the levers relative to the base to advance the first pair of end portions of the levers causes the fulcrum surfaces to apply clamping forces to the remote surfaces of the levers centrally intermediate their opposite ends.

12 Claims, 9 Drawing Figures

VEHICLE BODY CLAMP

BACKGROUND OF THE INVENTION

Various forms of auto body component engaging clamps heretofore have been provided and some of these clamps include structure whereby the clamping force on the auto body component engaged thereby is increased as tension is applied to the clamp. While these previously known forms of clamps are operative in various different auto body straightening situations and are adjustable, at least to some degree, as to the thickness of the workpiece which may be clamped between the jaw portions thereof, they are not readily adjustable to the thickness of work to be clamped thereby and are not constructed in a manner whereby the clamp may be quickly engaged with the workpiece independent of a pulling force being applied to the clamp.

Accordingly, a need exists for an auto body clamp whose clamping action on the desired auto body component may be readily effected independent of a pulling force being applied to the clamp. Further, a need also exists for an auto body clamp operable in a manner such that the clamp may be readily adjusted to accommodate auto body component parts of different thicknesses.

Examples of previously known forms of auto body clamps including some of the general structural and operational features of the instant invention are disclosed in U.S. Pat. Nos. 3,744,838, 3,835,693, 3,955,249 and 4,148,210.

BRIEF DESCRIPTION OF THE INVENTION

The clamp of the instant invention includes a pair of elongated jaws and a pair of spaced apart relatively rigidly supported fulcrum surfaces embrace the jaws intermediate their opposite ends. The jaws are longitudinally shiftable relative to the fulcrum surfaces and the remote sides of the jaws opposing the fulcrum surfaces are convergent toward a first pair of ends of the jaws defining auto body component gripping surfaces. The fulcrum surfaces are supported from a base structure relative to which the jaws are longitudinally slidable and structure is provided for operation, during clamping action of the jaws on an auto body component, to prevent longitudinal shifting of the jaws relative to each other, but enabling the necessary longitudinal shifting of the jaws relative to the base structure in order to apply a clamping force by the jaws on the auto body component gripped therebetween.

The main object of this invention is to provide an auto body component gripping clamp including structure whereby the clamp may be readily adjusted for different thickness of auto body portions to be clampingly engaged thereby.

Another object of this invention is to provide an auto body component clamp constructed in a manner whereby the clamping action on an associated auto body component will be automatically increased as tension is applied to the clamp.

Another very important object of this invention is to provide an auto body clamp constructed in a manner whereby it will automatically increase the clamping action thereof on an associated auto body component as tension is applied to the clamp, but also including structure whereby the clamp may be initially engaged with an auto body component independent of tension being applied to the clamp.

A final object of this invention to be specifically enumerated herein is to provide an auto body clamp in accordance with the preceding objects and which will conform to conventional forms of manufacture, be of simple construction and easy to use, so as to provide a device that will be economically feasible, long lasting and relatively trouble-free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
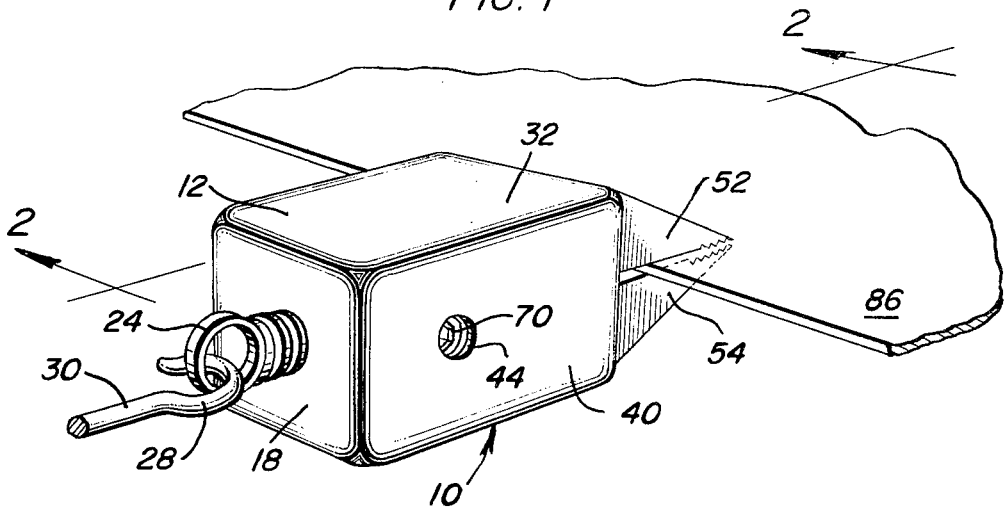
FIG. 1 is a perspective view of a first form of auto body clamp of the instant invention operatively associated with an auto body sheet metal component.

Referring now more specifically to the drawings, the numeral 10 generally designates a first form of clamp of the instant invention. The clamp 10 includes a housing or base component 12 and a pair of elongated jaws 14 and 16. The housing 12 comprises a rectangular tubular housing having an end wall 18 closing one end thereof and open at its other end 20. The end wall 18 includes a threaded bore 22 formed therein and an anchor eye 24 is provided and includes a threaded shank portion 26 threadedly engaged in the bore 22. A hook member 28 carried by one end of an elongated tension member 30 is releasably engaged with the anchor eye 24.

The housing 12 includes upper and lower walls 32 and 34 and the ends of the walls 32 and 34 at the open end 20 of the housing 12 include inwardly projecting fulcrums or abutments 36 and 38. The housing 12 further includes a pair of opposite side walls 40 and 42 and the side walls 40 and 42 include openings 44 and 46 formed therein for a purpose to be hereinafter more fully set forth.

The levers or jaws 14 and 16 include remote longitudinal surfaces 48 and 50 which are convergent toward one pair of corresponding ends 52 and 54 of the jaws 14 and 16. The ends 52 and 54 include opposing workpiece gripping surfaces 56 and 58 and the remote ends 60 and 62 of the jaws 14 and 16 include opposing partial cylindrical surfaces 64 and 66. A two-piece positioning pin 68 is provided and includes threadedly engaged first and second sections 70 and 72 insertable through the openings 44 and 46 and removably threadedly engaged with each other as at 74. The positioning pin 68 is embracingly engaged in the recesses 64 and 66.

Figure 2:
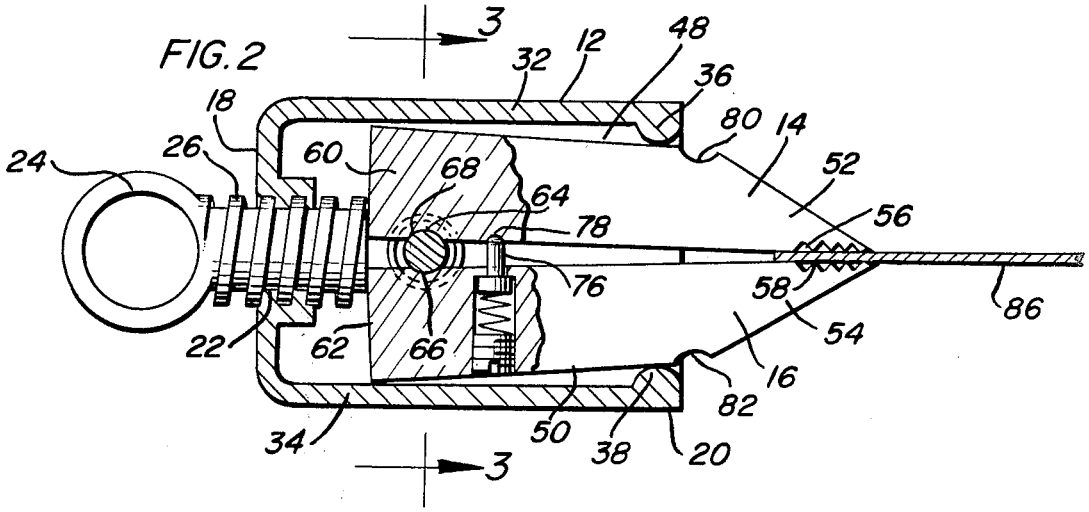
FIG. 2 is an enlarged longitudinal vertical sectional view taken substantially upon the plane indicated by the section line 2—2 of FIG. 1.
Figure 3:
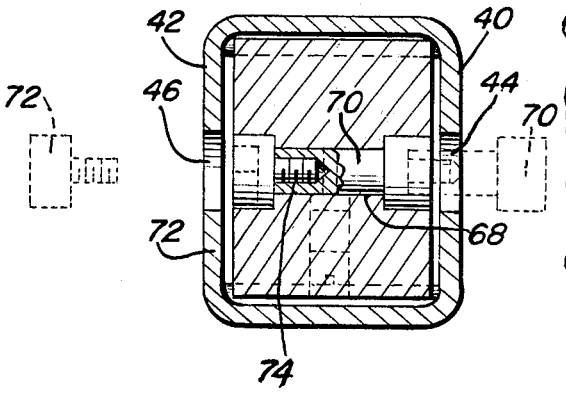
FIG. 3 is a transverse sectional view taken substantially upon the plane indicated by the section line 3—3 of FIG. 2.

From FIG. 2 of the drawings, it may be seen that the jaw or lever 16 removably supports a spring biased detent pin 76 and that the jaw 52 includes an opposing detent recess 78.

The inner end of the shank portion 26 is abuttingly engageable with the inner ends 60 and 62 of the jaws or levers 14 and 16 and may be utilized to force the jaws 14 and 16 forwardly relative to the open front end 20 of the housing 12 so as to project the ends 52 and 54 of the levers 14 and 16 from the open end 20 of the housing 12.

When the jaws 14 and 16 are retracted rearwardly into the housing 12 to the left of the positions thereof illustrated in FIG. 2 of the drawings, the abutments or fulcrums 36 and 38 are registered with recesses 80 and 82 formed in the opposing portions of the front ends 52 and 54 of the jaws or levers 14 and 16 thus enabling the front ends 52 and 54 to be displaced apart. After being displaced apart, the front ends 52 and 54 of the jaws 14 and 16 may be engaged with a sheet metal component 86 and the shank 26 may be threadedly advanced through the bore 22 and engaged with the rear ends of the jaws or levers 14 and 16 to forwardly displace the latter from the front end 20 of the housing 12. As the fulcrums or abutments 36 and 38 engage the forwardly convergent remote surfaces 48 and 50 of the jaws 14 and 16, the forward ends 52 and 54 of the jaws 14 and 16 clampingly engage the sheet metal component 86 therebetween. Then, as tension is applied to the tension member 30 and transferred to the eye 24, the housing 12 is shifted slightly rearwardly relative to the jaws 14 and 16 causing the abutments 36 and 38 to cam the forward ends of the jaws 52 and 54 even more tightly together against the workpiece of sheet metal component 86.

Figure 4:
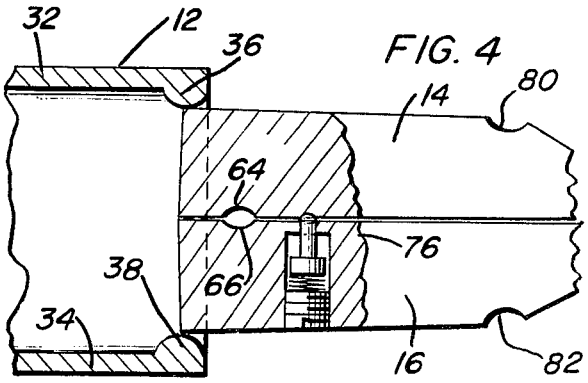
FIG. 4 is a fragmentary vertical sectional view similar to the right hand portion of FIG. 2, but with the jaws of the clamp in a forwardly displaced position preparatory to being removed from the base of the clamp.

When it is desired to remove the jaws 14 and 16 from the housing 12 in order to recondition the same or to replace the jaws 14 and 16 with other jaws (not shown) having slightly different jaw faces 56 and 58, the positioning or pivot pin 68 is removed by unthreading the end sections 70 and 72 from each other and removing the end sections 70 and 72 through the openings 44 and 46. Then, the jaws 14 and 16 are forwardly displaced relative to the housing 12 and removed from the forward end thereof in the manner illustrated in FIG. 4 of the drawings.

Figure 5:
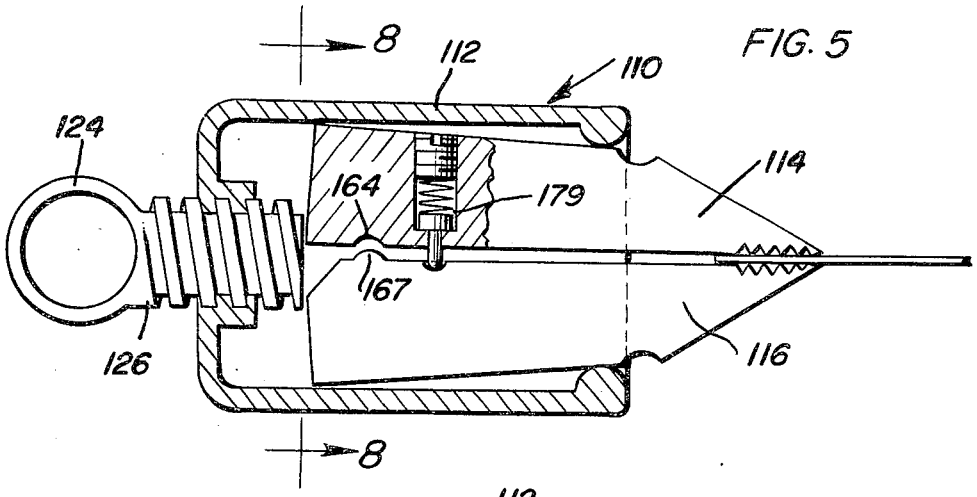
FIG. 5 is a longitudinal vertical sectional view similar to FIG. 2, but illustrating a modified form of clamp with the jaws or levers thereof lightly clampingly engaged with an auto body sheet metal component preparatory to being tightly clampingly engaged with the sheet metal components.
Figure 6:
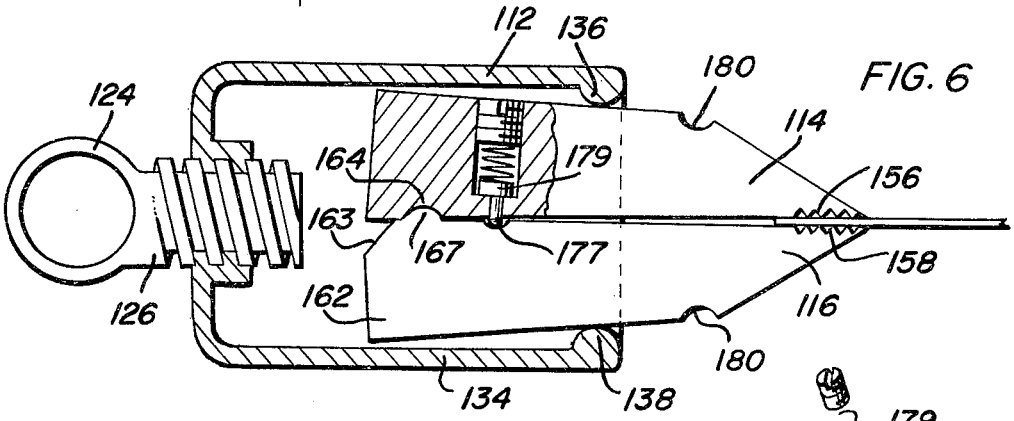
FIG. 6 is a longitudinal sectional view similar to FIG. 5, but illustrating the jaws of the clamp tightly clampingly engaged with the associated auto body component.
Figure 8:
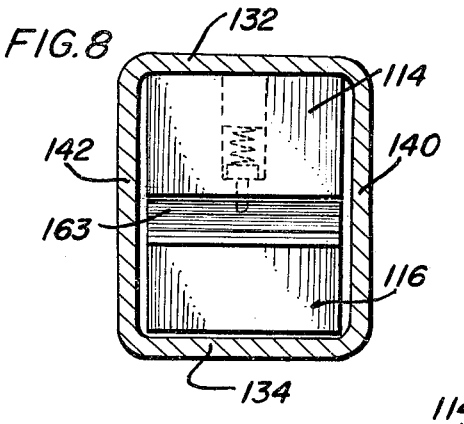
FIG. 8 is a transverse sectional view taken substantially upon the plane indicated by the section line 8—8 of FIG. 5.
Figure 9:
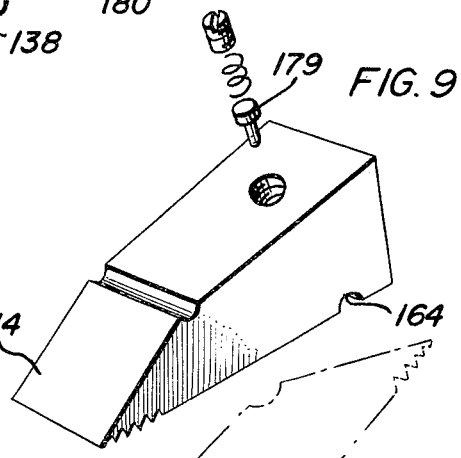
FIG. 9 is a perspective view of the upper clamp jaw illustrated in FIG. 7.

With reference now more specifically to FIG. 5 of the drawings, there may be seen a modified form of clamp referred to in general by the reference numeral 110. The clamp 110 is substantially similar to the clamp 10 and the various component parts of the clamp 110 which correspond directly to the various components of the clamp 10 are designated by similar reference numerals in the 100 series.

The main difference between the clamps 10 and 110 is that in lieu of the partial cylindrical recess 66 provided on the jaw 16, the jaw 116 includes a partial cylindrical projection 167 which is receivable in the partial cylindrical recess 164 formed in the jaw 114 corresponding to the recess 64. Further, the jaw 116 includes a detent recess 177 corresponding to the detent recess 78 in the jaw 52 and the jaw 114 includes a spring biased detent pin 179 corresponding to the detent pin 76. Also, the rear end 162 of the jaw 116 includes a beveled cam surface 163 for camming the detent pin 179 upwardly relative to the jaw 114 when the jaw 116 is displaced rearwardly into the housing 112 relative to the jaw 114.

Figure 7:
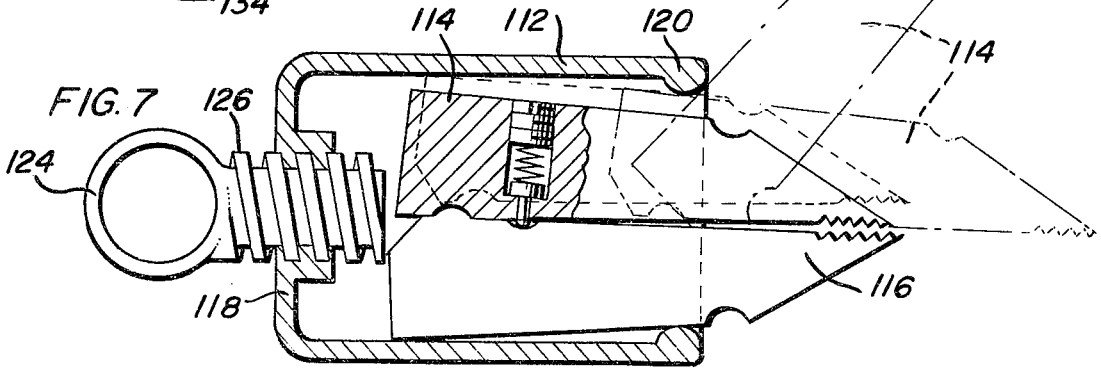
FIG. 7 is a longitudinal sectional view of the second form of auto body clamp with alternate sequential positions of one of the jaws or levers of the clamp shown in phantom lines to indicate the manner in which the clamp jaws may be removed from the supportive base structure of the clamp.

When it is desired to remove the jaws 114 and 116 from the housing 112, the jaws 114 and 116 are first initially rearwardly displaced in the housing 112 and the jaw 114 is thereafter forwardly displaced relative to the housing 112 and the jaw 116 whereby the rear end of the jaw 114 will be cammed up over the projection 167 and be allowed to slide forwardly relative to the jaw 116 from the forward open end 120 of the housing 112 (see FIG. 7). Otherwise, the operation of the clamp 110 is substantially identical to the operation of the clamp 10.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. An auto body gripping clamp including a base component defining a pair of spaced opposing abutment surfaces, a pair of elongated side-by-side levers including first and second pairs of corresponding end portions projecting in opposite directions from opposite sides of a plane transverse to said levers and containing said abutment surfaces, said levers being supported from said base component for longitudinal shifting relative thereto, said first pair of end portions projecting from one side of said plane defining opposing jaw surfaces for clamping an auto body portion therebetween, means carried by said base component for attaching a pull member thereto for applying a pulling force thereon in a direction opposite to the direction in which said first pair of end portions project, said levers including pairs of remote and adjacent longitudinal surfaces, said remote surfaces being slightly divergent toward said second end portions, said remote surfaces being slidably engageable with said abutment surfaces to cam said first pair of end portions toward each other upon shifting of said levers relative to said base component in longitudinal directions of said levers in which said first end portions thereof project, and pivot means operatively associated with the opposing sides of the second pair of end portions of said levers interconnecting the latter for relative angular displacement about an axis extending transversely of said levers for swinging of said first pair of end portions toward and away from each other.

2. The combination of claim 1 wherein said base component comprises a tubular housing having a first open end from which said first pair of end portions project.

3. The combination of claim 2 wherein said abutment surfaces are supported from opposite side portions of said tubular housing adjacent said open end thereof.

4. An auto body gripping clamp including a base component defining a pair of spaced opposing abutment surfaces, a pair of elongated side-by-side levers including first and second pairs of corresponding end portions projecting in opposite directions from opposite sides of a plane transverse to said levers and containing said abutment surfaces, said levers being supported from said base component for longitudinal shifting relative thereto, said first pair of end portions projecting from one side of said plane defining opposing jaw surfaces for clamping an auto body portion therebetween, means carried by said base component for attaching a pull member thereto for applying a pulling force thereon in a direction opposite to the direction in which said first pair of end portions project, said levers including pairs of remote and adjacent longitudinal surfaces, said remote surfaces being slightly divergent toward said second end portions, said remote surfaces being slidably engageable with said abutment surfaces to cam said first pair of end portions toward each other upon shifting of said levers relative to said base component in longitudinal directions of said levers in which said first end portions thereof project, said adjacent longitudinal surfaces including coacting projection and recess fulcrum means interfittingly engageable with each other and operable to prevent relative longitudinal displacement of said levers.

5. The combination of claim 1 wherein said jaw faces include meshing transverse serrations.

6. An auto body gripping clamp including an elongated base defining a pair of spaced opposing opposite side abutments at one end, a pair of elongated side-by-side levers disposed and laterally spaced apart between said abutments and including remote longitudinal surfaces slidably engaged with said abutments and slightly divergent toward one pair of ends of said levers, the other pair of ends of said levers defining opposing jaw faces, and pivot means operatively associated with the opposing sides of said levers adjacent said one ends thereof interconnecting said levers for relative angular displacement about an axis extending transversely of said levers for swinging of said jaw faces toward and away from each other, said levers being longitudinally displaceable, as a unit, relative to said base in directions advancing said other pair of lever ends.

7. An auto body gripping clamp including an elongated base defining a pair of spaced opposing side abutments at one end, a pair of elongated longitudinally extending and laterally spaced apart levers disposed between said abutments, longitudinally shiftable relative to said base and including remote longitudinal surfaces slidably engaged with said abutments intermediate the opposite ends of said levers, said remote surfaces being slightly convergent toward one pair of ends of said levers, said one pair of ends defining opposing jaw faces, positive displacement means carried by said base operable to displace said levers in the longitudinal directions relative to said base and advancing said one pair of ends, said adjacent longitudinal surfaces including coacting projection and recess fulcrum means interfittingly engageable with each other and operable to prevent relative longitudinal displacement of said levers.

8. An auto body gripping clamp including an elongated base defining a pair of spaced opposing side abutments at one end, a pair of elongated longitudinally extending and laterally spaced apart levers disposed between said abutments, longitudinally shiftable relative to said base and including remote longitudinal surfaces slidably engaged with said abutments intermediate the opposite ends of said levers, said remote surfaces being slightly convergent toward one pair of ends of said levers, said one pair of ends defining opposing jaw faces, positive displacement means carried by said base operable to displace said levers in the longitudinal directions relative to said base and advancing said one pair of ends, said one pair of ends of said levers projecting endwise outwardly from said one end of said base and said other end of said base including means for anchoring one end of an elongated tension member thereto.

9. The combination of claim 7 wherein said base includes means supported from the other end thereof operative to adjustably longitudinally displace said levers relative to said base in directions advancing said one pair of ends of said levers relative to said base.

10. The combination of claim 7 wherein said projection and recess means include a detent recess formed in one lever and a spring biased detent pin supported from the other lever and seated in said recess.

11. The combination of claim 7 wherein said projection and recess means include a partial cylindrical recess in one lever and a partial cylindrical projection carried by the other lever seated in said recess.

12. The combination of claim 7 wherein said projection and recess means include opposing partial cylindrical recesses formed in said levers and a cylindrical pin disposed between said levers and having opposite sides thereof removably seated in said recesses.

* * * * *